US005932955A

United States Patent [19]

Berger et al.

[11] Patent Number: 5,932,955

[45] Date of Patent: Aug. 3, 1999

[54] DOUBLE-BASED, DOUBLE-ENDED, PINCH-SEALED ELECTRIC LAMP WITH INTEGRAL BASE

[75] Inventors: Helmut Berger, Lindlar; Juergen Eder, Cologne; Hans Liermann, Kuerten, all of Germany

[73] Assignee: Patent-Treuhand-Gesellschaft F.Elektrische Gluehlampen MBH, Munich, Germany

[21] Appl. No.: 08/747,619

[22] Filed: Nov. 13, 1996

[30] Foreign Application Priority Data

Dec. 22, 1995 [DE] Germany ..... 195 48 523

[51] Int. Cl.[6] ..... H01J 5/48; H01J 5/50; H01J 1/62; H01J 63/04

[52] U.S. Cl. ..... 313/318.02; 313/318.07; 313/493; 313/634

[58] Field of Search ..... 313/17, 25–26, 313/318.01–318.03, 318.07, 318.09–318.1, 493, 623, 631, 633, 491.92

[56] References Cited

U.S. PATENT DOCUMENTS

| | | | |
|---|---|---|---|
| 3,646,387 | 2/1972 | Ayres . | |
| 4,870,316 | 9/1989 | Otani | 313/25 |
| 5,006,757 | 4/1991 | Odagaki | 313/318.02 X |
| 5,142,195 | 8/1992 | Heider et al. . | |
| 5,153,482 | 10/1992 | Keijser et al. | 313/634 |
| 5,241,239 | 8/1993 | Rao . | |
| 5,424,608 | 6/1995 | Juengst et al. | 313/623 |

FOREIGN PATENT DOCUMENTS

| | | |
|---|---|---|
| 0 451 647 | 10/1991 | European Pat. Off. . |
| 0 547 683 | 6/1993 | European Pat. Off. . |
| 428414 | 5/1935 | United Kingdom . |

*Primary Examiner*—Sandra O'Shea
*Assistant Examiner*—Mack Haynes
*Attorney, Agent, or Firm*—Frishauf, Holtz, Goodman, Langer & Chick, P.C.

[57] ABSTRACT

To eliminate the necessity of a separate base for a pinch-sealed lamp having a glass bulb, a sleeve (11) made of the same material as the bulb (1) of the lamp, is formed on an extension of the pinch seal (6), the sleeve retaining a contact element (13) secured in the sleeve, for example by molten glass. The contact element (13) extends essentially transverse to a longitudinal axis (A) of the lamp, is recessed within the interior of the sleeve (11) and preferably has a circumference, which is spaced from said axis (A) by circumferentially different distances, optionally in accordance with a mathematical function which, further optionally, is a periodic function, wherein the minimum spacing of the circumference of said contact element from the axis (A) is less than the inner radius of the sleeve (11).

20 Claims, 4 Drawing Sheets

DOUBLE-BASED, DOUBLE-ENDED, PINCH-SEALED ELECTRIC LAMP WITH INTEGRAL BASE

Reference to related patents and application, the disclosures of which are hereby incorporated by reference:

U.S. Pat. No. 5,142,195, Heider et al, assigned to the assignee of the present application;

U.S. Pat. No. 5,241,239, Rao;

U.S. application Ser. No. 08/658,635, filed Jun. 5, 1996, Streppel et al, assigned to the assignee of the present application, now U.S. Pat. No. 5,686,794, issued Nov. 11, 1997.

FIELD OF THE INVENTION

The present invention relates to a double-ended pinch-sealed lamp, which defines a longitudinal axis. At respective opposite ends of the lamp, the lamp bulb is pinch-sealed by surrounding a sealing foil which connects internal and external current supply leads, communicating, respectively, outside of the pinch seal and inside with the bulb. The ends of the externally extending leads are connected to bases having contact elements, for connection to supply contacts in lamp sockets, within which the lamp can be retained. The lamp may be an incandescent lamp, as well as a discharge lamp; the invention is particularly applicable to tubular, or elongated lamps; the elongated lamps may be quite long, for example when they are made in form of metal halide lamps, ultraviolet (UV) radiators for cosmetic or medical applications, or the like; the lamps may also be sodium high-pressure lamps.

BACKGROUND

Double-ended, double pinch-sealed lamps are usually supplied with bases made of a ceramic sleeve. Metallic connecting elements are located within the sleeve. Usually, the connection contact is disk-shaped, or it may button-shaped or dished. The sleeve, frequently, is slit; the slit is pushed on the pinch seal and retained on the pinch seal by a cement or the like.

It has been found that the use of cement has some disadvantages, particularly if the lamp is subjected to high temperatures. The bond between the base and the adjacent lamp portion may not be reliable over a long period of time. The cement is acidic; the acid therein, as well as remnants of solvents can corrode the current supply leads. It has already been tried to connect the ceramic sleeve to the pinch seal without cement—see, for example, U.S. Pat. No. 5,241,239, Rao. Manufacturing such lamps, however, is complex, time-consuming and expensive.

THE INVENTION

It is an object to provide a double-ended, double pinch-sealed lamp which can be easily and inexpensively manufactured, and is particularly well-suited for automatic production.

Briefly, a sleeve made of the same material as the lamp bulb itself—typically quartz glass or hard glass—is formed on the outer end portion of the respective pinch seal. The contact element is secured in the interior of the sleeve and extends in a plane essentially transversely to the lamp axis. The lamp and the base sleeve, thus, form an integral unitary structure. The contact element is removed from the immediate vicinity of the lamp bulb.

The structure in accordance with the present invention has the advantage that the ceramic materials used for sleeves in accordance with the prior art can be entirely eliminated; cement, likewise, need not be used. The time-consuming heating, or annealing of the base cement is also completely eliminated. The glass base sleeve can be made, and/or shaped at the same time as the pinch seal is made, so that a single production step is all that is necessary to form the pinch seal, as well as the base.

The double-ended, double pinch-sealed electric lamp in accordance with the present invention includes a vacuum-tight elongated lamp bulb which defines a longitudinal axis. At opposite ends, pinch seals are formed which, each, include a connecting foil which interconnects the inner and outer current supply leads. The bases are formed at the outer ends of the pinch seals. The bases generally comprise a sleeve, formed of the same material as the lamp bulb which is formed on the end of the pinch seal. The sleeve has an inner and an outer diameter. The wall thickness, forming the difference between the two diameters, usually is in the order of about 1 millimeter, the precise dimension depending on the type of the lamp. A contact element is secured within the interior of the sleeve, for example melt-set therein, which is conductively connected with the outer current supply lead which, in turn, connects to the pinched foil. The contact element, usually, extends at least approximately perpendicularly to the lamp axis.

The basic shape of the contact element is in form of a plate, or disk. The general form can be substantially changed, however, since it may also be mushroom-shaped, pin-shaped, or even in form of a knife blade contact element. The contact element is attached in the sleeve by embedding at least an edge portion of the contact element in the sleeve, that is, melting the sleeve around the edge portion, or pinch molding or sealing the edge portion of the contact sleeve in the base material so that the contact element is retained in the sleeve.

In accordance with a particularly preferred embodiment, the contact element is disk-like, in which the edge of the disk varies, circumferentially, with respect to the center point of the disk. This variation may be in accordance with a mathematical function and, for example, be periodic. This is particularly important because there is practically no metallic material suitable for the contact element which has a thermal coefficient of expansion matched to the thermal coefficient of expansion of the material of the bulb, and hence of the base sleeve which, usually, is quartz glass. A severe mis-match would, in operation, soon lead to cracks and fissures in the material of the bulb, that is, the quartz glass, which would decrease the lifetime of the lamp. A metal suitable for the electrical contacts is specialty steel, for example V2A, especially if nickel-plated; nickel, or copper, respectively, and possibly silver-plating or gold-plating may also be used.

In accordance with a particularly preferred embodiment, the minimal radius of the contact element is smaller than the interior radius of the sleeve; the contact element may have various basic shapes, for example, clover leaf-shaped, elliptical, triangular, polygonal or the like e.g., in accordance with a periodic function wherein the period is related to the radial symmetry of a ring and the polygon has n corners within the ring. The structure repeats every 360°. FIG. 3*c* shows such a polygon where n=4. Corners of the contact element should, in practical use, preferably be rounded. Such arrangements minimize stresses, particularly if both above features are used. The contact element is then reliably anchored within the glass sleeve.

The current supply lead, which connects a pinched foil to the contact element may have various forms, and basically may be made in two modes: in accordance with one mode, the current supply lead is a wire, and the contact element has an attachment portion or region, such as a narrow neck, to form an eye into which the wire can be fitted. Alternatively, the wire-type current supply lead may be angled, and in contact with the contact element; the angled-off end is then welded to the contact element; in accordance with another feature, the contact element may be butt-welded with the wire.

In accordance with a second mode, the external current supply lead also is a foil—and, for example, an elongated portion of the pinched foil. The usual foils used in pinch seals are molybdenum foils. They are stable enough in order to take over the task of the external current supply. Preferably, an elongated end portion of the foil is angled off, and a longitudinal side of the angled-off portion is welded to the contact element.

The contact element, preferably, is bulged towards the current supply lead if the current supply lead is angled-off, or bent towards the contact element. Such a concave bulge assures a particularly good weld connection.

The contact element is reliably held in the glass sleeve if the engagement region, that is, the edge of the contact element has a thickness of between about 0.3 and 0.8 mm. This is also a good thickness for the entire contact element.

Manufacturing the base from a glass sleeve can be combined with the manufacture of such lamps by means of a four-jaw pinching machine, as described, for example, in the referenced U.S. Pat. No. 5,142,195, Heider et al, assigned to the assignee of the present application. The only variation that is necessary is to shape the jaws, such that the jaws will also form the base. They then will include an integrated shaping arrangement which forms not only the pinch seal but, simultaneously, also the glass sleeve. In an intermediate step, the end of the lamp bulb, and particularly the region which later on will form the glass base sleeve, is heated to deformation temperature. Surface tension will result in a defined inherent deformation of the end of the bulb, such that its diameter will decrease. The pinch jaws, which will form a matrix for the desired shape of the base, are moved to the bulb to close the bulb by the jaws; at the same time, the base geometry is formed, and the contact element, which is held in position by suction, or by a jig, or by pincers, is secured in the sleeve. A predetermined inner diameter of the glass sleeve can readily be obtained by suitable selection of timing and/or temperature, or other operating parameters during the manufacture.

DRAWINGS

FIG. 1, collectively, illustrates a tubular halogen incandescent lamp in side view, in which FIG. 1*a* is a front view of the lamp, and FIG. 1*b* is a side view, that is, the lamp of FIG. 1*a* rotated 90°;

FIG. 2 is a top view of a contact element for the lamp of FIG. 1;

FIG. 3, collectively, illustrates various embodiments of contact elements, in which FIG. 3*a* is a round contact element, FIG. 3*b* a triangular contact element, and FIG. 3*c* a polygonal, specifically square contact element with rounded-off corners;

FIG. 4 illustrates another embodiment of the end portion of a halogen incandescent lamp, wherein

FIG. 5 is a cross-section of a contact element and its electrical and mechanical connection to an external current supply lead, and FIG. 6, collectively, shows a metal halide lamp, in which

DETAILED DESCRIPTION

Figure 1A:
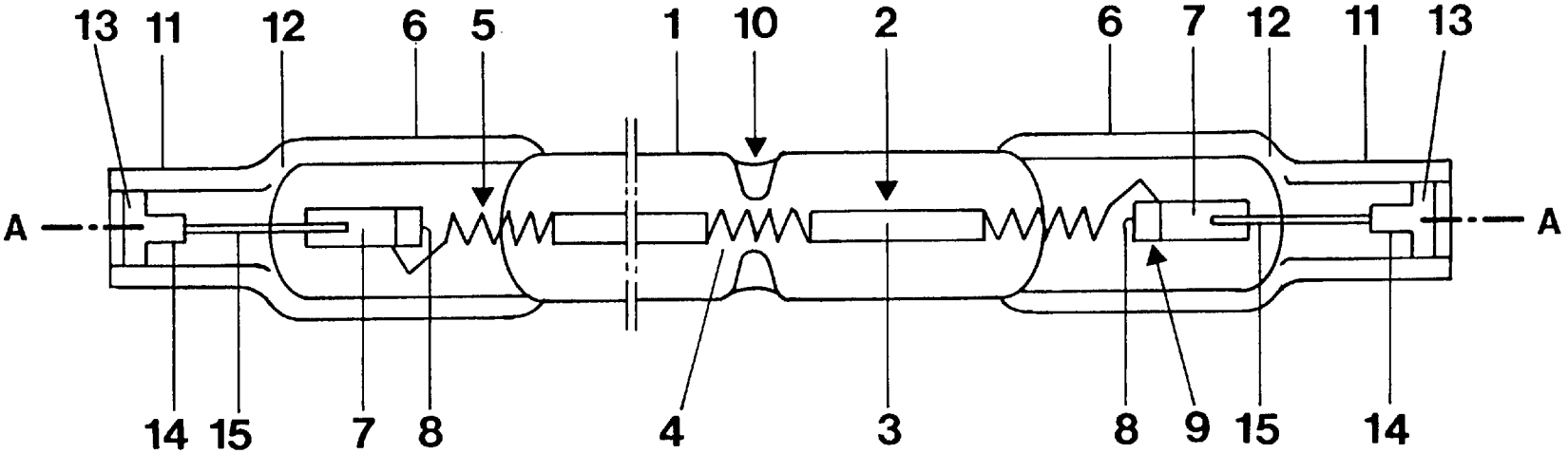
Figure 1B:
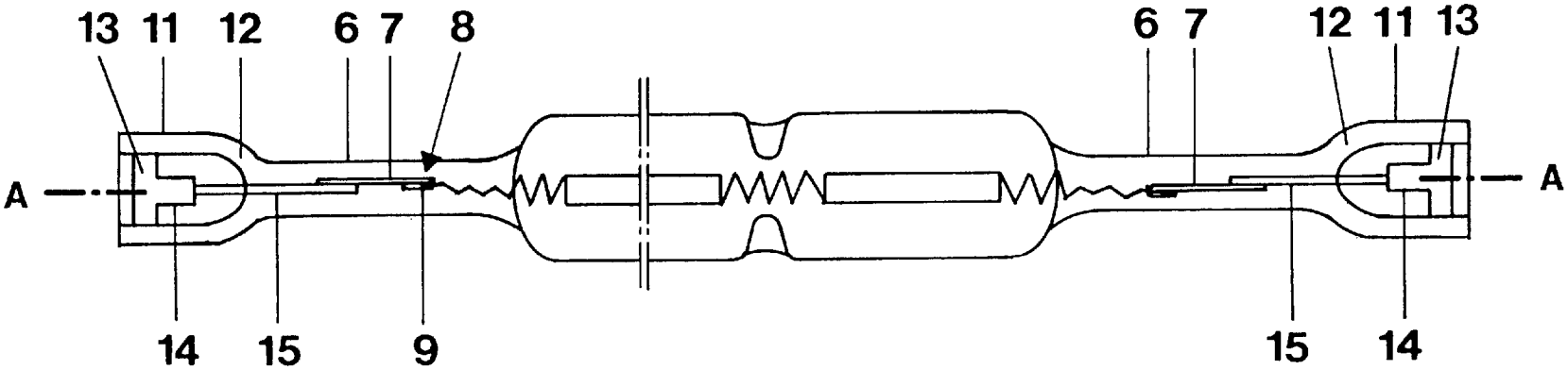

Referring first to FIG. 1, collectively, the lamp has a cylindrical bulb 1 in which a light source, shown as a filament 2, is located along its longitudinal axis. The light source 2 is held in the bulb 1 by dimples 10—see the referenced application U.S. Ser. No. 08/658,635, filed Jan. 5, 1996, Streppel et al, assigned to the assignee of the present application, now U.S. Pat. No. 5,686,794, issued Nov. 11, 1997. The light source or light-emitting device 2, in the form of an incandescent filament, has luminous portions 3 which are comparatively tightly wound, that is, with low pitch, and separated from each other by non, or only slightly radiating portions 5 of steep, or high pitch. The ends 5 of the filament 2 also are formed of essentially non-luminous portions of high pitch. The ends 5 are embedded directly in pinch seals 6 and form inner current supply leads. The pinch seals 6 retain a pinched foil 7, which is connected to the end 5 of the filament. The end 8 of the foil 7, which faces the interior of the bulb, is bent backward within the pinch seal to form an inner bend 9 within which the end portion of the end 5 of the filament is introduced, and held mechanically in position, while providing an excellent electrical contact with the foil 7. A typical thickness for the foil 7 is 2.5 $\mu$m.

Figure 2:
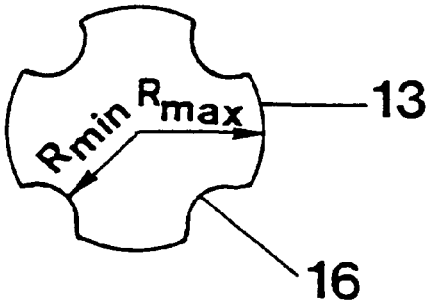

The base, in accordance with the present invention, is a tubular glass sleeve 11 which is formed on, and hence integral with the pinch seal 6 to provide the base. The sleeve 7 has an outer diameter of 7 mm and an inner diameter of 5 mm, and has a length of about 7 mm. It is narrower than the width of the pinch seal 6, but wider than the narrow side of the pinch seal 6. A transition zone 12 is located between the pinch seal 6 and the sleeve 11. A disk-shaped contact element 13 is embedded in the sleeve 11, and thus retained therein positioned transversely to a longitudinal axis A of the lamp, and recessed from the outer end of the sleeve by about 3 mm. The contact element 13 is made of sheet steel of the type V2A, having a thickness of 0.4 mm—see FIG. 2. Its shape is generally clover leaf in form. This circumferential surface defines a first surface portion with the maximum radius $R_{max}$ of 2.7 mm and a second surface portion with a minimum radius $R_{min}$ of 2 mm. The minimum radius appears at the bottom of four recesses 16. The recesses 16 are part circular and stamped out of the disk 16. The recesses 16 serve as a holding assist during manufacture to permit holding the contact element by a pincer or gripper, or the like, for example similar to needle-nose pliers. A hollow neck portion 14 (FIG. 1, collectively) is secured to or formed on the backside of the contact element 13. A molybdenum wire having a diameter of 0.6 mm is connected to the pinched foil 7 to form an external current supply lead 15, which is welded to the neck portion 14.

Figure 3A:
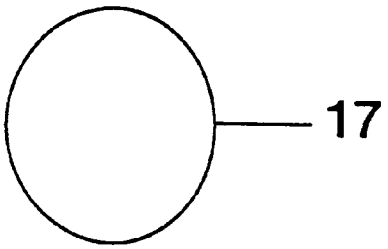
Figure 3B:
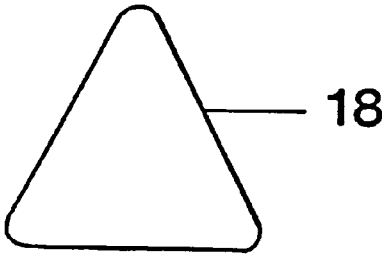
Figure 3C:
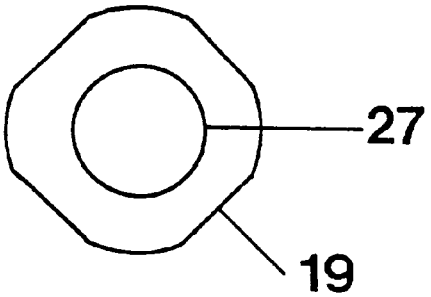

The contact element may have various shapes; for example, it may be an elliptical contact element 17 (FIG. 3*a*), a triangular element 18 (FIG. 3*b*), or a polygonal, typically essentially square element 19 (FIG. 3*c*). The element 19 is a disk of 0.5 mm, formed with a concave central bulge 27 having a diameter of 3 mm. The largest diameter of the element 19 is 5.4 mm, and the minimum diameter is 5 mm. The corners of element 18, as well as of element 19, are rounded.

Figure 4A:
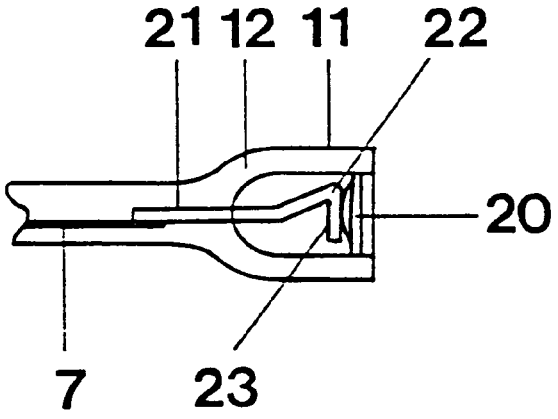
FIG. 4*a* is a side view.
Figure 4B:
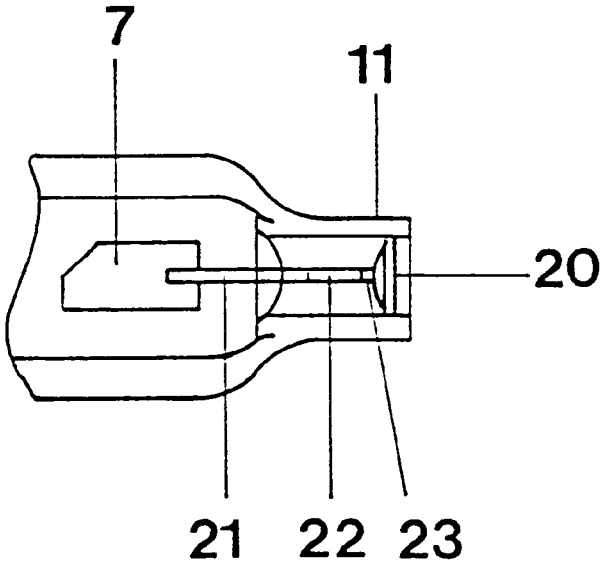
FIG. 4*b* is a front view, that is, FIG. 4*a* rotated by 90°.
Figure 5:
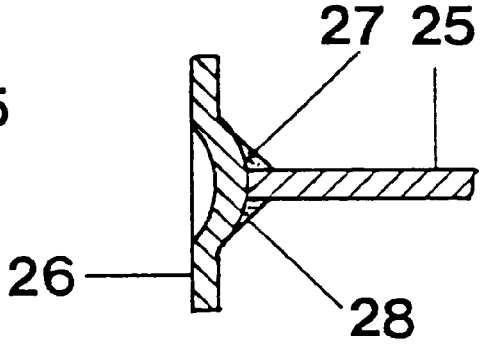

FIG. 4, collectively, shows another way of attaching the external current supply lead to the contact element. The external current supply lead is a wire 21, which is angled at the end 22, to form an angled portion 23. The angled portion 23 is welded to the backside of the contact element 20 by resistance welding. Rather than resistance welding an angled-off portion, an external current supply wire 25 (FIG. 5) can be butt-welded directly with the contact element 26 in the region of the bulge portion 27, forming a small welded region 28.

Figure 6A:
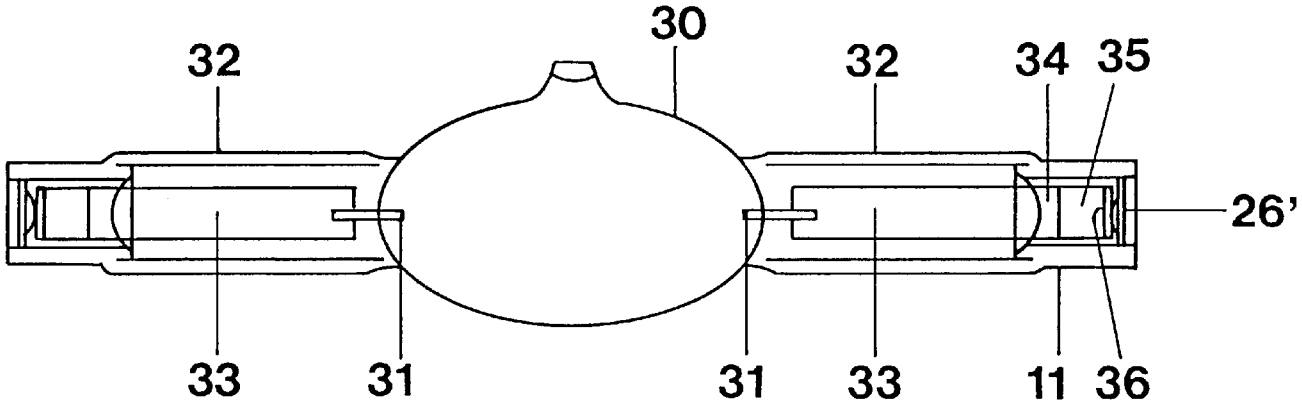
FIG. 6*a* is a side view, and FIG. 6*b* a front view, that is, the view of FIG. 6*a* rotated by 90°.
Figure 6B:
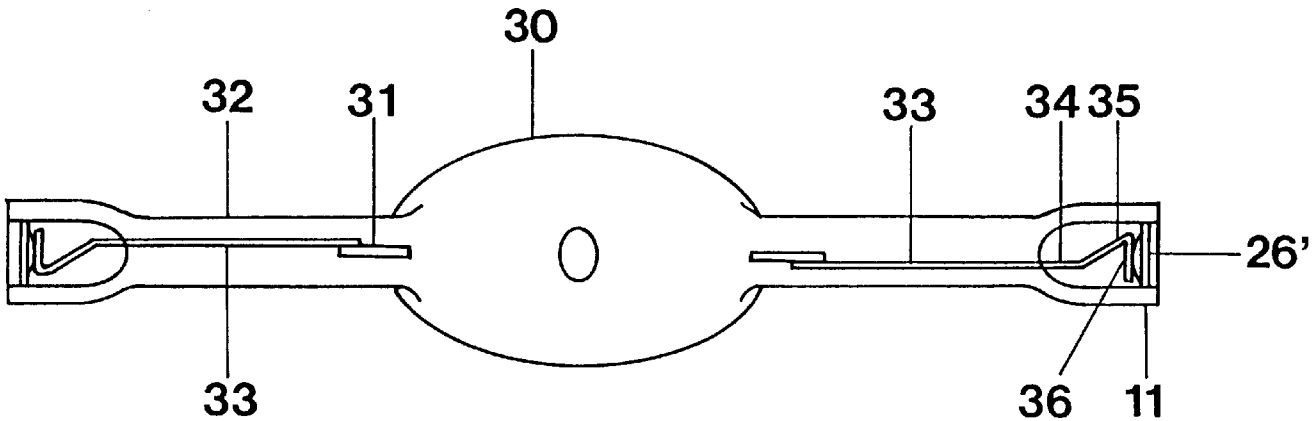

FIG. 6, collectively, shows, highly schematically, a metal halide discharge lamp. The bulb 30 is barrel-shaped, made of quartz glass, and includes two electrodes 31 and a metal halide fill to provide, in operation, for light emission. The ends of the bulbs are sealed by pinch seals 32, in which the foils 33 are embedded. The external supply lead is formed by an extension 34 of the respective pinched foil 33. The extension 34 is angled off in the region of the glass sleeve 11, and welded with its longitudinal side 36 to the backside of the internally bulging contact element 26'.

Various changes and modifications may be made, and any features described herein in connection with any one of the embodiments may be used with any of the others, within the scope of the inventive concept.

A typical wall thickness of the bulb 1 (FIG. 1) is 0.7 to 1.1 mm and the glass used, typically, is quartz glass or vycor. A typical wall thickness for the bulb 30 (FIG. 6) is 2 to 2.5 mm, and the glass used, preferably is quartz glass.

We claim:

1. Double-based, double ended, pinch-sealed electrical lamp having a vacuum-tight lamp bulb (1, 30) of glass defining a longitudinal lamp axis (A);

light-emitting means (3, 31) located within said bulb;

pinch seals (6, 12) located at opposite outer ends of said bulb along said axis, and defining outer end portions thereof, each pinch seal including:

outer current supply leads (15, 21, 25, 34), pinched foils (7,33) connecting the light-emitting means (3, 31) with the outer current supply leads; and a lamp base at each end of the lamp, including a contact element electrically connected with one of said outer current supply leads (15, 21, 25, 34), wherein, in accordance with the invention, each lamp base comprises a sleeve (11) made of the same material as the lamp bulb and formed on the outer end portion of the respective pinch seal (6, 32) as an integral part of the respective outer end portion; and wherein the contact element (13, 17, 18, 19, 26, 26') is secured to the interior of said sleeve (11), retained by said sleeve, and extends in a plane essentially transverse to said lamp axis (A), whereby the bulb and the base sleeve, retaining said contact element, form an integral unitary structure.

2. The lamp of claim 1, wherein said contact element (13) is disk-shaped.

3. The lamp of claim 2, wherein at least a portion of the edge of the disk-shaped contact element (13) is melted into said sleeve (11).

4. The lamp of claim 1, wherein the contact element has a circumference, which includes at least one surface portion which is spaced from said axis (A) by a circumferential distance which differs from a circumferential distance of at least a second surface portion, optionally in accordance with a mathematical function.

5. The lamp of claim 4, wherein the minimum spacing of the circumference of one of said surface portions of said contact element from the axis (A) is less than the inner radius of the sleeve (11).

6. The lamp of claim 4, wherein said contact element has clover leaf shape, or elliptical shape, or essentially triangular shape, or essentially polygonal shape.

7. The clamp of claim 1, wherein the outer current supply lead (15) comprises a wire.

8. The lamp of claim 1, wherein the outer supply lead comprises a foil (34), optionally a prolongation, or an extension of said pinch foil (7, 33).

9. The lamp of claim 7, wherein the contact element (26) is formed with a bulge (27), and said outer current supply lead is secured to said bulge.

10. The lamp of claim 8, wherein the contact element (26) is formed with a bulge (27), and said outer current supply lead is secured to said bulge.

11. The lamp of claim 1, wherein the lamp comprises one of:

a filamentary incandescent lamp; and a discharge lamp.

12. A lamp base unitary and in combination with a pinch-sealed lamp bulb (1, 30) made of glass, wherein the base comprises a sleeve (11) made of the same material as the lamp bulb and formed on the outer end portion of a pinch seal (6, 32) of the lamp bulb (1, 30);

wherein a contact element (13, 17, 18, 19, 26, 26') is provided, secured to the interior of said sleeve (11), and extending in a plane transversely to a central axis (A) of the lamp; and wherein an electrical connection lead (15, 21, 25, 34) is provided, extending from the pinch seal to the contact element, and electrically connected thereto, whereby the lamp bulb, the pinch seal and the sleeve of the base will form an integral unitary structure.

13. The combination of claim 12, wherein said contact element is essentially dish- or disk-shaped, and wherein at least a portion of the edge of the contact element (13) is melted into said sleeve (11).

14. The lamp of claim 12, wherein the contact element has a circumference, which includes at least one surface portion which is spaced from said axis (A) by a circumferential distance which differs from a circumferential distance of at least a second surface portion, optionally in accordance with a mathematical function.

15. The lamp of claim 14, wherein the minimum spacing of the circumference of one of said surface portions of said contact element from the axis (A) is less than the inner radius of the sleeve (11).

16. The combination of claim 14, wherein said contact element has clover leaf shape, or elliptical shape, or essentially triangular shape, or essentially polygonal shape.

17. The combination of claim 12, wherein the outer current supply lead (25) comprises a wire.

18. The combination of claim 12, wherein the outer supply lead comprises a foil (34), optionally a prolongation, or an extension of said pinch foil (7, 33).

19. The combination of claim 17, wherein the contact element (26) is formed with a bulge (27), and said outer current supply lead is secured to said bulge.

20. The combination of claim 18, wherein the contact element (26) is formed with a bulge (27), and said outer current supply lead is secured to said bulge.

* * * * *